United States Patent [19]

Ishino et al.

[11] Patent Number: 4,510,705

[45] Date of Patent: Apr. 16, 1985

[54] WATER-BOTTOM RUBBLES LEVELING APPARATUS

[75] Inventors: Yoshitane Ishino, Odawara; Toshihisa Naruse; Toshiyuki Sawano, both of Hiratsuka, all of Japan

[73] Assignee: Kabushiki Kaisha Komatsu Seisakusho, Tokyo, Japan

[21] Appl. No.: 563,731

[22] Filed: Dec. 21, 1983

[51] Int. Cl.[3] ..... E02F 5/00

[52] U.S. Cl. ..... 37/54; 405/15; 405/172; 405/226; 37/76

[58] Field of Search ..... 405/15–19, 405/172, 222, 223, 158–165, 226; 37/72–79, 54, 56, 57

[56] References Cited

U.S. PATENT DOCUMENTS

| | | | |
|---|---|---|---|
| 55,347 | 6/1866 | Nobles | 37/77 |
| 303,392 | 8/1884 | Lonney | 37/76 X |
| 315,520 | 4/1885 | Lonney | 37/76 X |
| 3,309,799 | 3/1967 | Kinkade | 405/272 X |
| 3,629,963 | 12/1971 | Itami | 37/54 |
| 3,783,626 | 1/1974 | Hansen | 37/54 X |

*Primary Examiner*—Dennis L. Taylor

*Attorney, Agent, or Firm*—Armstrong, Nikaido, Marmelstein & Kubovcik

[57] ABSTRACT

A water-bottom rubbles leveling apparatus which includes a main body frame having a plurality of telescopic legs, a first movable frame mounted on the main body frame for movement in the longitudinal direction thereof, and a second movable frame having a plurality of telescopic legs mounted on the first movable frame for movement in the lateral direction of the main body frame. A carrier is mounted on the main body frame for movement in the longitudinal direction of the main body frame. Mounted to the carrier projecting downwardly therefrom are a rake and a leveling roller both for effecting leveling work.

7 Claims, 18 Drawing Figures

WATER-BOTTOM RUBBLES LEVELING APPARATUS

BACKGROUND OF THE INVENTION

The present invention relates to a water-bottom rubbles leveling apparatus for leveling the upper surface of a rubble-mound or riprap formed by rubbles pilled up on the bottom of the water.

Many of outer facilities in harbors such as breakwaters and revetments are caisson type composite dikes formed by sinking a concrete caisson onto a rubble-mound which comprises a pile of rubbles on the bottom of the water. Generally, such caisson type composite dikes are constructed through the following stage of works: (1) sinking rubbles onto the bottom of the water from a ship, (2) leveling the rubbles, (3) installing a caisson from a ship, (4*a*) packing the caisson with sand, (4*b*) installing blocks, and (5) completing the top of the caisson.

The work for leveling the upper surface of the above-mentioned rubble-mound indicated at the reference numeral 1 has heretofore been conducted manually by divers.

Although most of the other construction works in harbors have already been mechanized, the foregoing rubble leveling work still relies on the divers' manual work. But the efficiency of the rubble leveling work by divers is extremely poor, and there is an increasing demand for mechanization under the background as will be described below.

(1) Most of the divers are of advanced ages because the number of persons who wish to become a diver is small, showing a tendency to shortage. (2) The number of large-scale construction works which require a rapid execution of work is increasing. (3) Harbors tend to extend to the offing, thus resulting in increased depth of water. (4) From the aspect of safety supervision, it is necessary to avoid human heavy labor involving some risks.

In view of the circumstances mentioned above, some methods for a mechanized execution of works have so far been proposed and tried, but have not been practically adopted yet because those methods involve problems in point of leveling accuracy, working efficiency, the size of stones capable of being leveled and cost.

Usually, crushed stones used as rubbles are each 30 to 200 kg in weight and 30 to 60 cm in size, and when sunk onto the water bottom, those stones form unevenness corresponding to ±50 cm or more. For a stable installation of caisson, it is required to level such unevenness with a very high accuracy, for example, within ±5 cm.

SUMMARY OF THE INVENTION

It is therefore an object of the present invention to provide a water-bottom rubbles leveling apparatus which is capable of self-propelling in longitudinal and lateral can perform leveling work efficiently and accurately.

Another object of the present invention is to provide a remote-controlled, self-propelling water-bottom rubbles leveling apparatus.

A further object of the present invention is to provide an efficient method of leveling water-bottom rubble-mound.

In accordance with an aspect of the present invention, there is provided a water-bottom rubbles leveling apparatus, comprising: a main body frame having a plurality of telescopic legs mounted thereto; a first movable frame mounted on said main body frame for movement in the longitudinal direction of said main body frame; a second movable frame mounted on said first movable frame for movement in the lateral direction of said main body frame, said second movable frame having a plurality of telescopic legs mounted thereto; means for effecting movement of said first movable frame relative to said main body frame; means for effecting movement of said second movable frame relative to said first movable frame; means for extending and retracting said telescopic legs of said main body frame and said second movable frame; a carrier mounted to said main body frame for movement in the longitudinal direction of said main body frame; means for effecting movement of said carrier; and a rake mounted to said carrier projecting downwardly therefrom.

In accordance with another aspect of the present invention, there is provided a method of leveling water-bottom rubbles by using a remote-controlled apparatus which is capable of self-propelling in a longitudinal and lateral directions and has a rake and a leveling roller mounted thereto, said method comprising the steps of: (a) sinking said apparatus on a water-bottom rubble-mound to be leveled; (b) adjusting said apparatus horizontally at a datum level; (c) leveling said rubble-mound by moving said rake horizontally in the longitudinal direction of said apparatus; (d) moving said leveling roller on the rake-leveled rubble-mound horizontally in the longitudinal direction of said apparatus; (e) moving said apparatus back and forth or sideways after completion of the leveling work of the assigned area; (f) repeating the above recited steps (c) and (d) for a newly assigned area; and (g) floating said apparatus above the water after completion of entire leveling of the rubble-mound.

The above and other objects, features and advantages of the present invention will be readily apparent from the following description taken in conjunction with the accompanying drawings.

DESCRIPTION OF THE PREFERRED EMBODIMENT

Figure 1:
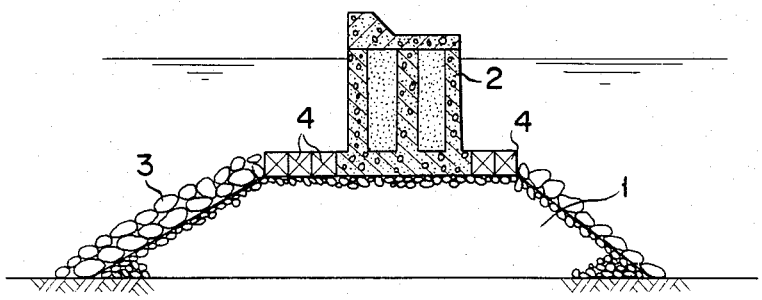
FIG. 1 is a schematic cross-sectional view of a breakwater.

The present invention will be described in detail hereinunder on the basis of an embodiment thereof illustrated in the drawings.

Referring first to FIG. 1, there is shown a section of a breakwater after execution of work, in which the reference numeral 1 denotes a rubble-mound; the numeral 2 denotes a caisson installed on the upper surface of the rubble-mound 1 after leveling; the numeral 3 denotes a covering stone which covers the upper surface of the rubble-mound 1; and the numeral 4 denotes a block.

Figure 2:
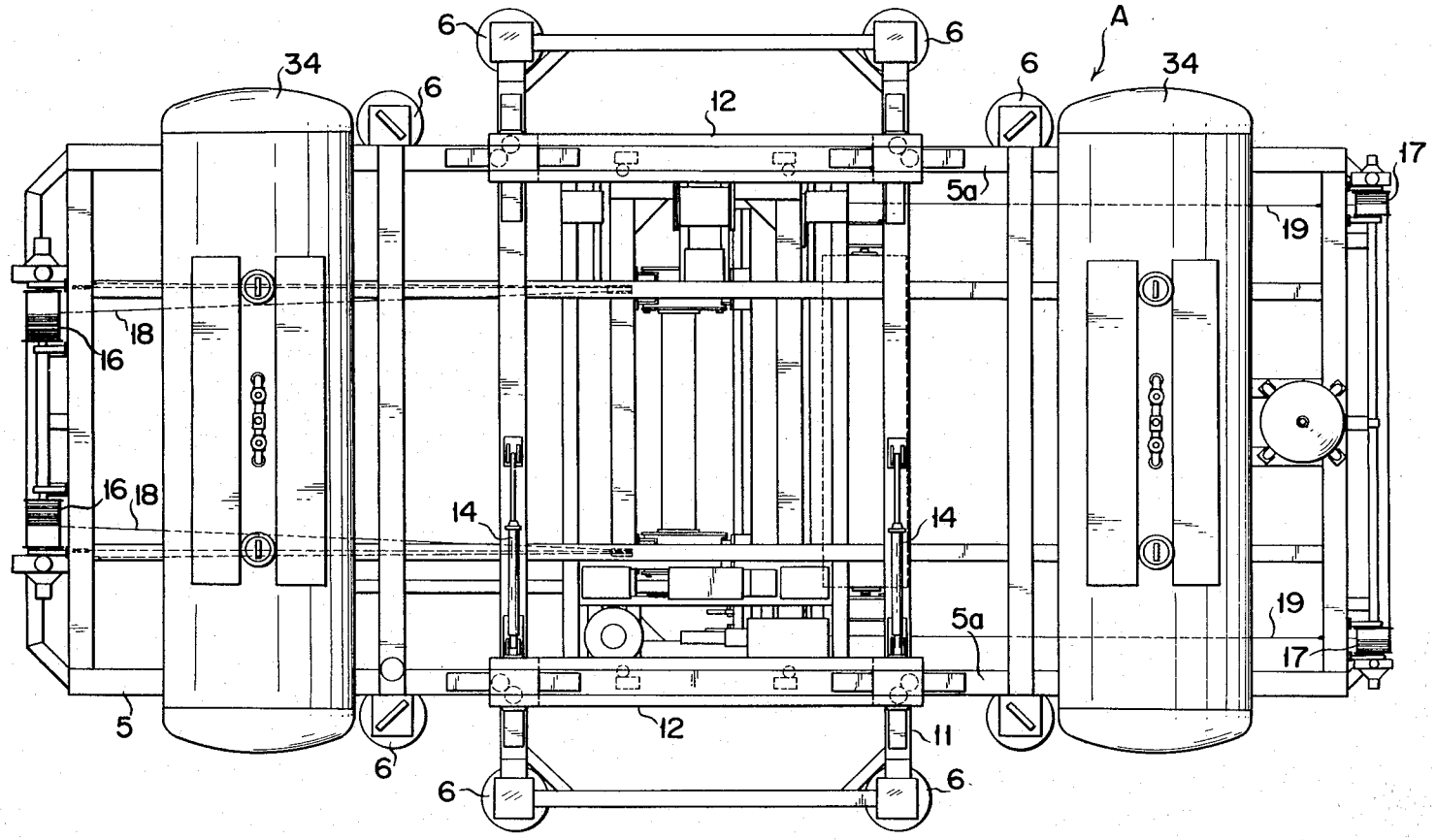
FIG. 2 is a top plan view of a water-bottom rubbles leveling apparatus according to the present invention.
Figure 3:
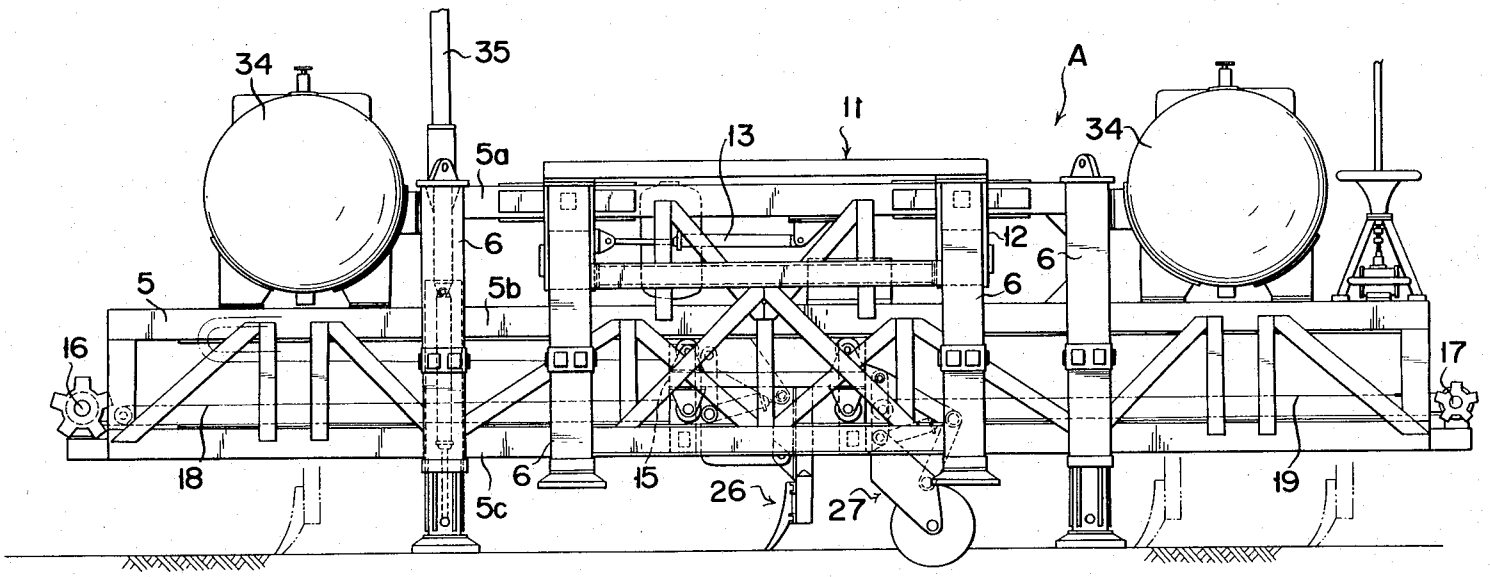
FIG. 3 is a side elevational view thereof.
Figure 4:
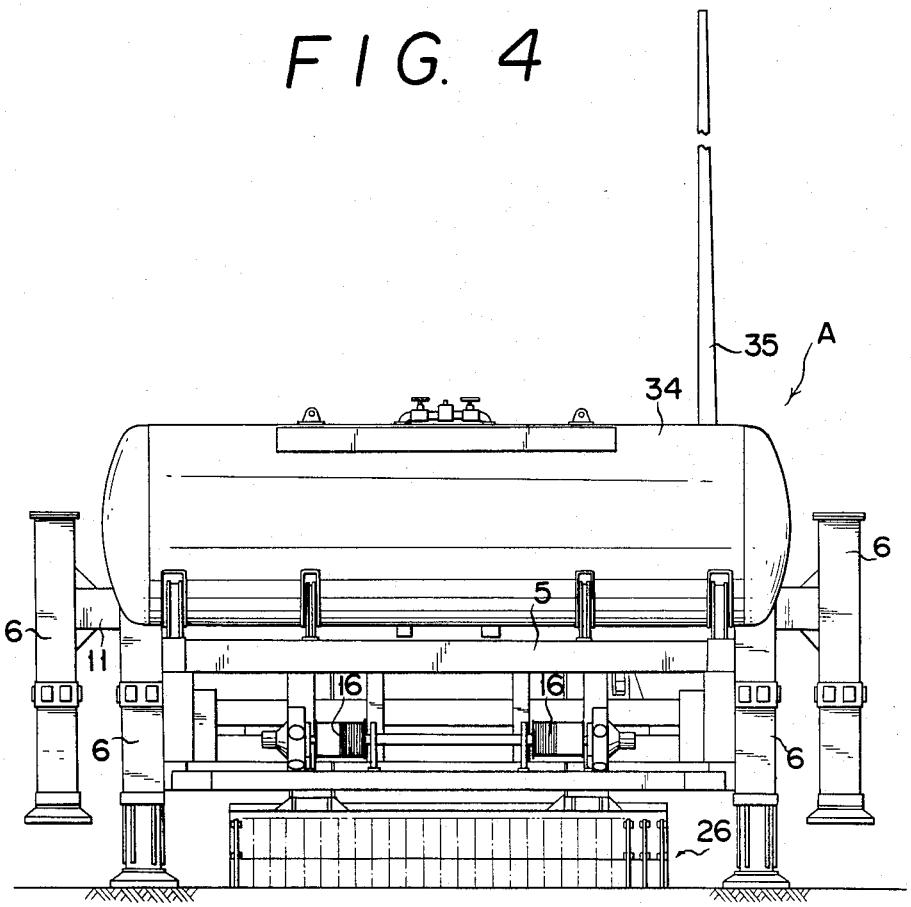
FIG. 4 is a front elevational view thereof.
Figure 5:
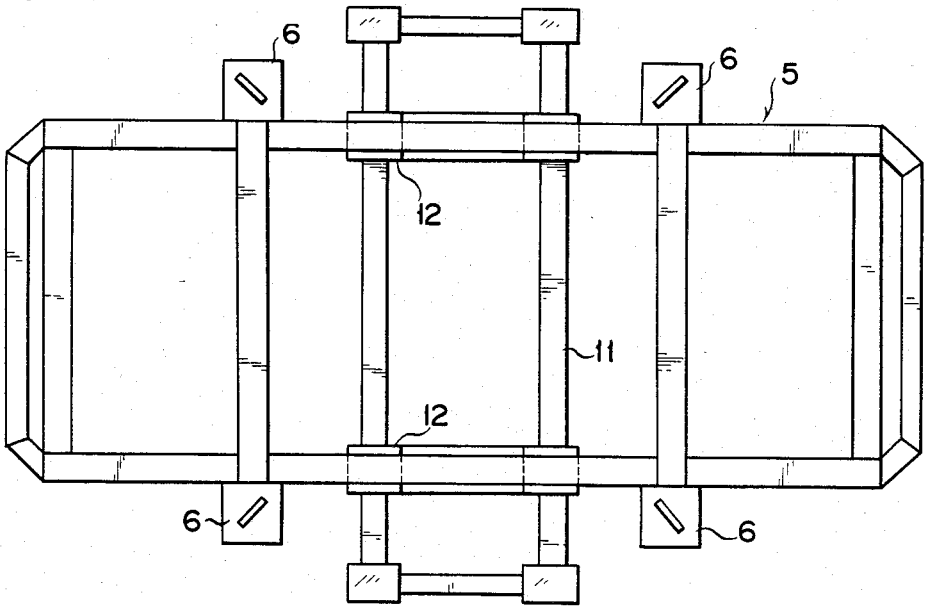
FIG. 5 is a top plan view showing schematically framework arrangement of the present invention.
Figure 6:
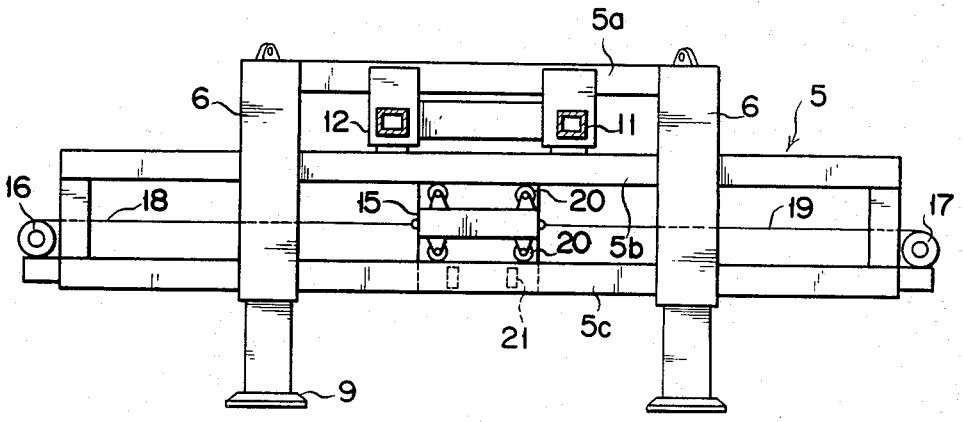
FIG. 6 is a side elevational view, partly in cross-section, of the framework arrangement of FIG. 5.
Figure 7:
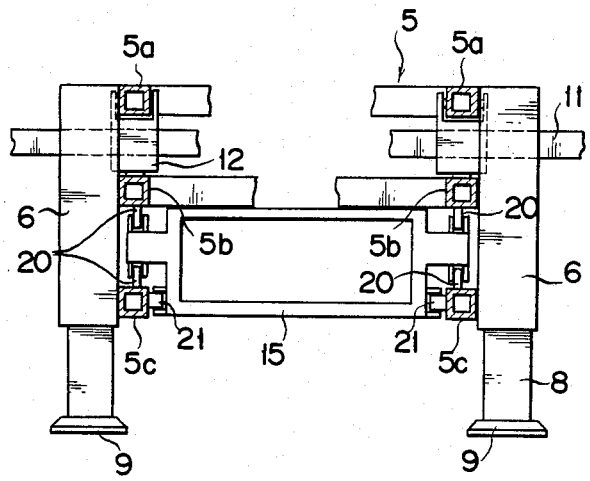
FIG. 7 is a front elevational view, partly in cross-section, of the framework arrangement of FIG. 5.
Figure 7A:
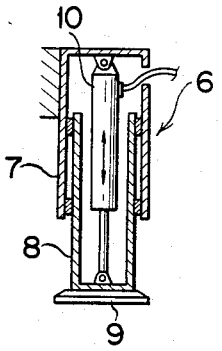
FIG. 7A is a longitudinal cross-sectional view of a leg.

FIG. 2 is a plan view showing the entirety of a water-bottom rubbles leveling equipment A embodying the present invention; FIG. 3 is a side view thereof; and FIG. 4 is a front view thereof. The numeral 5 in the drawings denotes a body leg frame of such a structure as shown in FIGS. 5 through 7. As shown in these figures, the body leg frame 5 is rectangular in plan view and has a three-stage construction in the vertical direction. Further, on each side in the longitudinal direction thereof there are provided two legs 6, that is, a total of four legs on both sides. The leg 6 comprises an outer pipe 7 fixed to the frame, an inner pipe 8 slidably fitted in the outer pipe 7, a foot 9 attached to the lower end of the inner pipe 8, and a cylinder device 10 for sliding the inner pipe 8 relative to the outer pipe 7. The longitudinal frame portions of the body leg frame 5 are each constituted by a square pipe.

The numeral 11 denotes a movable leg frame which is also rectangular in plan view and which is provided at the four corners thereof with legs 6 of the same construction as those of the body leg frame 5.

A walking frame 12 is engaged between an upper transverse frame 5*a* and a middle transverse frame 5*b* slidably along both transverse frame 5*a* and 5*b*. The walking frame 12 and the body leg frame 5 are interconnected through cylinder devices 13. Further, the transverse frame portions of the movable leg frame 11 are engaged with the walking frames 12 slidably in the direction perpendicular to the longitudinal direction of the body leg frame 5, and the movable leg frame 11 and the walking frame 12 are interconnected through cylinder devices 14.

A carriage 15 is engaged with both the middle transverse frame 5*b* and a lower transverse frame 5*c* of the body leg frame 5 so as to be movable throughout the full length in the longitudinal direction thereof. To both front and rear end portions in the moving direction of the carriage 15 are respectively connected one ends of ropes 18 and 19 wound round winches 16 and 17 which are provided at both end portions in the longitudinal direction of the body leg frame 5. The engagement between the carriage 15 and the transverse frame portions of the body leg frame 5 is effected through upper and lower rollers 20 and side rollers 21.

Figure 8:
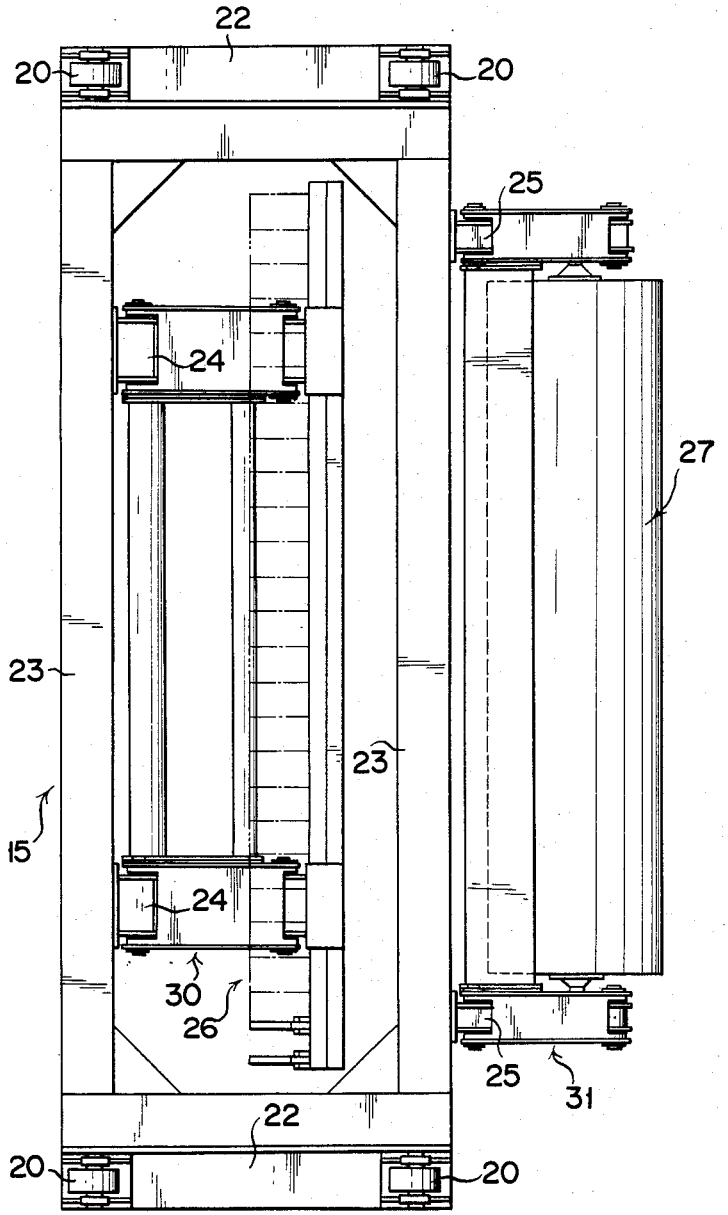
FIG. 8 is a top plan view of a carrier and leveling equipment assembly.
Figure 9:
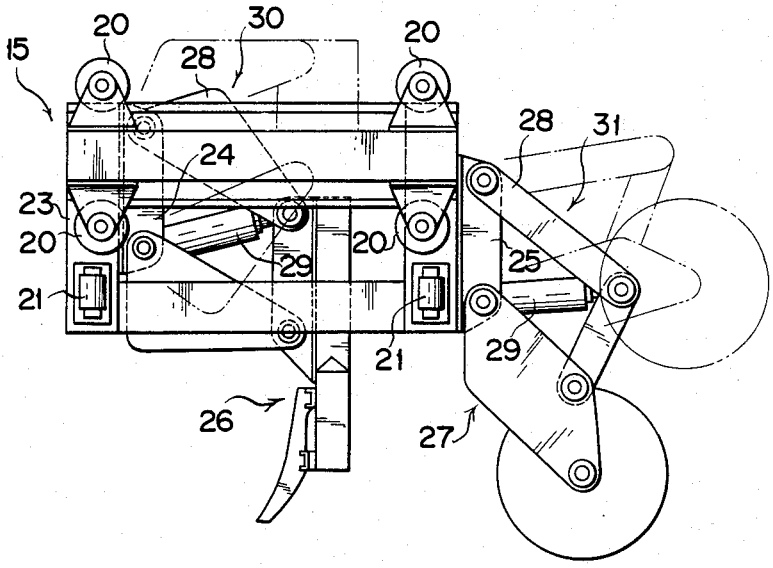
FIG. 9 is a side elevational view thereof.
Figure 10:
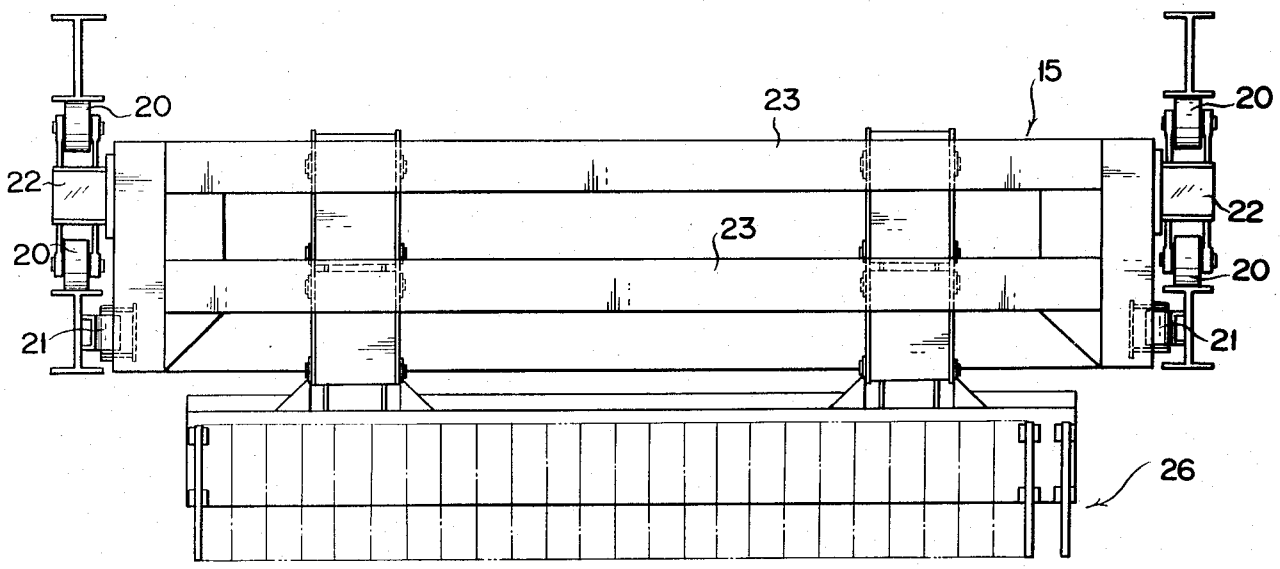
FIG. 10 is a front elevational view thereof.

The carriage 15 is of such a construction as shown in FIGS. 8 through 10, in which the rollers 20 are disposed above and below right and left frame members 22 in the moving direction of the carriage, and the side rollers 21 are disposed outside the frame members 22.

Further, brackets 24 and 25 are disposed respectively behind front and rear frame members 23 in the moving direction of the carriage 15. The front and rear brackets 24 and 25 are equipped with a rake device 26 and a rolling roller device 27, respectively.

Figure 11:
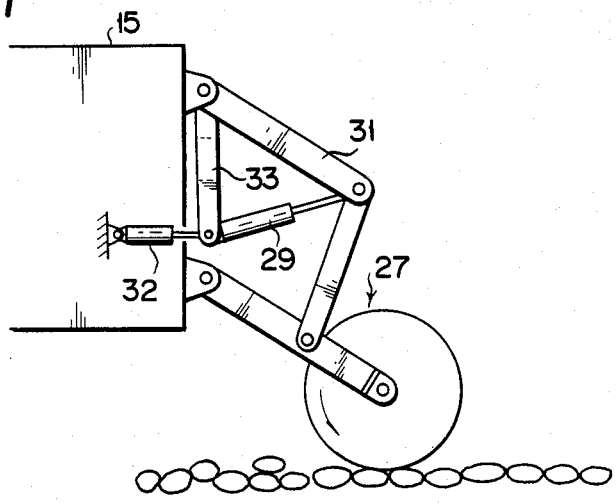
FIG. 11 is a schematic side elevational view of a leveling roller assembly.

Both devices 26 and 27 are adapted to be moved up and down by means of lift devices 30 and 31 respectively each consisting of a quadric link mechanism 28 and a lift cylinder 29. The base end portions of the lift cylinders 29 of the lift devices 30 and 31 are connected to the bracket side each through a buffer cylinder 32 as shown in FIG. 11. The numeral 33 denotes a link which restricts the connection between the lift cylinder 29 and the buffer cylinder 32.

The numeral 34 denotes a float tank mounted on each of the front and rear portions of the body leg frame 5. The float tanks 34 are each connected to a compressor mounted on a mother ship. The numeral 35 denotes a staff attached to the top of the body leg frame 5. The staff 35, which is of an upright structure, serves as an index for measuring the position of the leveling equipment and the depth of water. To the tip end portion above the surface of the sea of the staff 35 is attached a level index.

Moreover, though not shown, an inclinometer for detecting the inclination of the leveling equipment is attached to the body leg frame 5.

Further mounted on the leveling equipment are a driving device such as a hydraulic device necessary for a remote control from the mother ship, a control device and a detecting device for detecting each operation stroke, etc.

In the leveling equipment, moreover, an ultrasonic topographical surveying instrument is attached to the carriage 15 for surveying the state of unevenness of the rubble surface before and after leveling.

The rubble leveling work by the equipment of the present invention will be described below with reference to FIGS. 12 et seq.

Figure 12:
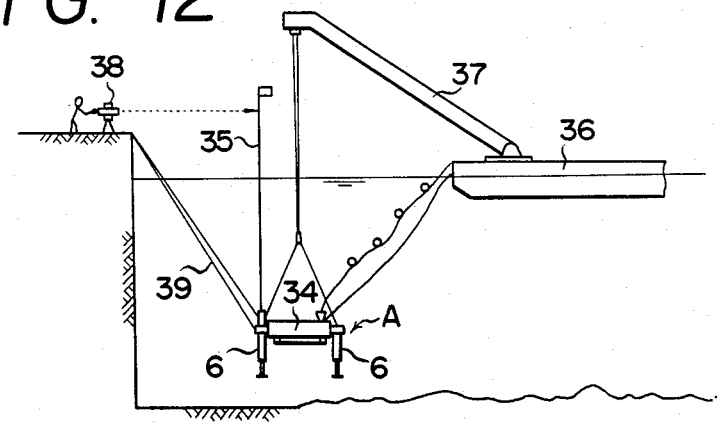
FIGS. 12 to 14(D) are views explanatory of working procedures according to the present invention.

Air is introduced into the float tanks 34 to float the rubble leveling equipment A on the surface of the sea, then in a suspended state of the leveling equipment A by a crane 37 of a crane ship 36, the air is withdrawn from the float tanks 34 and at the same time water is poured into the tanks, so that the leveling equipment sinks in accordance with the descending speed of the crane 37 (see FIG. 12). At this time, the worker on the quay of caisson watches the staff to measure the position through a transit 38 or the like, and corrects the landing posture by using a rope 39. The leveling equipment is landed on the rubble-mound through the four legs 6 of the body leg frame 5 and then the legs 6 are adjusted in length to level the frame.

Figure 13:
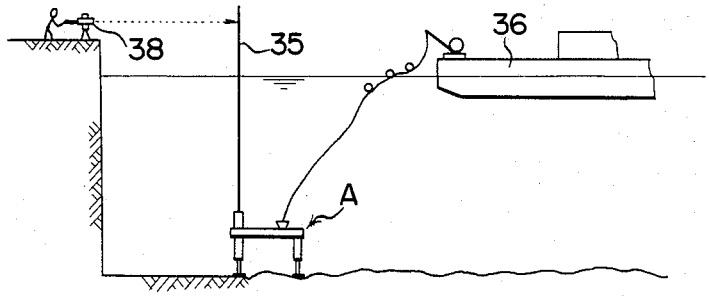
Figure 14A:
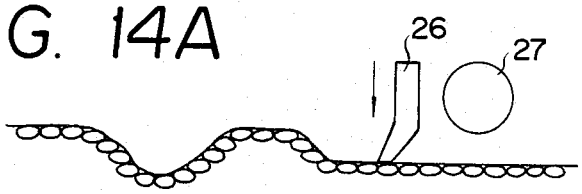
Figure 14B:
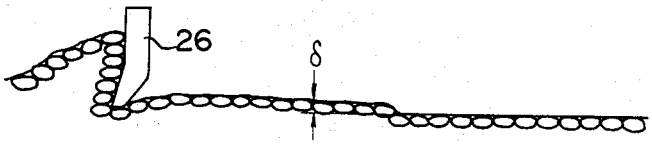
Figure 14C:
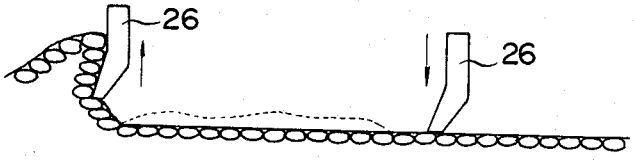
Figure 14D:
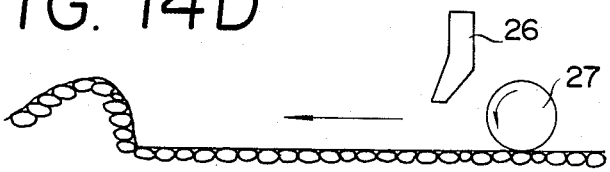

Then, the level index at the tip end portion of the staff 35 is watched through the transit 38 from the quay or the like to measure the datum level, and on the basis of this measurement the control panel in a mother ship 36 is operated to set the level adjusting amount. Thereafter, the landed legs 6 are expanded or contracted to level the body leg frame 5 at a predetermined height (see FIG. 13).

After completion of setting the level of the body leg frame, the leveling work is started. During this leveling work, only the legs 6 of the body leg frame 5 are landed on the rubble-mound, while the legs 6 of the movable leg frame 11 are held in their raised positions.

The leveling work is performed in accordance with the following stage of works, as shown in FIGS. 14(A) through 14(D). (1) The rake device 26 is brought down to the bottom dead center and set at the leveling height (FIG. 14(A)). (2) The carriage 15 is pulled by the front winch 16 to let the rake device 26 push and level the rubbles (FIG. 14(B)). At this time, the rake device 26 escapes by δ under the action of the buffer cylinder 32, so the leveling is not attained. To effect the leveling completely, the rake device 26 is pulled back by the rear winch 17 and is reciprocated until the rake escape amount becomes zero (FIG. 14(C)). When the leveling reaction is so large that an overload results during the leveling operation by the rake device 26, the rake device 26 is pulled up by 20 to 30 cm to reduce the load and then leveling is performed. (3) When the leveling operation by the rake device 26 is over, the rake device 26 is raised for storage, then the rolling device 27 is brought down and a finish leveling is performed by reciprocating the carriage 15 (about three times) in the same manner as in the above leveling operation by the rake device 26 (FIG. 14(D)).

After completion of the above leveling operation, the leveling equipment is moved in the transverse direction by walking so as to give a sufficient overlap with the portion already leveled.

For walking, (1) the rake device 26 and the rolling roller device 27 are raised for storage and then the carriage 15 is moved to the center. (2) The movable leg frame 11 is moved in a desired direction and its legs 6 are landed on the rubble-mound, then the legs 6 of the body leg frame 5 are raised and the body leg frame 5 is moved in the same direction as the previous movement of the movable leg frame 11, then its legs 6 are landed on the rubble-mound, and from this state the above operations are repeated for movement by a predetermined distance. (3) After completion of walking, the body leg frame 5 is adjusted to perform its level setting, followed by repetition of the above-mentioned leveling operation and the transverse movement.

When the leveling operation for a predetermined area is completed in accordance with the aforementioned stage of works, air is introduced into the float tanks 34, then the leveling equipment is raised by the crane and floated and then moved by towage.

According to the water-bottom rubbles leveling equipment of the present invention constructed as described in detail hereinabove, since the body leg frame 5 landed on the rubble-mound serves as a base for the leveling operation, this operation can be done without influence of waves. Moreover, since the rubbles projecting above a predetermined level can be rolled by the rolling roller device 27 immediately after the leveling operation by the rake device 26, the leveling operation can be done with a high accuracy. Further, since the carriage 15 moves while being guided by the body leg frame 5 which serves as a base and the leveling operation is performed by the rake device 26 and rolling roller device 27 attached to the carriage, it is possible to level the unevenness rapidly. Additionally, since the entire leveling equipment can walk back and forth and to the right and left, the leveling operation can be done efficiently for a wide area.

What is claimed is:

1. A water-bottom rubbles leveling apparatus, comprising:

a main body frame having a plurality of telescopic legs mounted thereto;

a first movable frame mounted on said main body frame for movement in the longitudinal direction of said main body frame;

a second movable frame mounted on said first movable frame for movement in the lateral direction of said main body frame, said second movable frame having a plurality of telescopic legs mounted thereto;

means for effecting movement of said first movable frame relative to said main body frame;

means for effecting movement of said second movable frame relative to said first movable frame;

means for extending and retracting said telescopic legs of said main body frame and said second movable frame;

a carrier mounted to said main body frame for movement in the longitudinal direction of said main body frame;

means for effecting movement of said carrier; and a rake mounted to said carrier projecting downwardly therefrom.

2. A water-bottom rubbles leveling apparatus according to claim 1 further comprising a leveling roller mounted for rotation to said carrier.

3. A water-bottom rubbles leveling apparatus according to claim 2 wherein said rake and said leveling roller are each mounted to said carrier through mounting means comprising a guadric linkage and means for raising and lowering said rake or said leveling roller.

4. A water-bottom rubbles leveling apparatus according to claim 3 wherein said raising and lowering means is a cylinder and wherein said apparatus further includes a cushion cylinder for mounting the guadric linkage to said carrier.

5. A water-bottom rubbles leveling apparatus according to claim 1 wherein said first and second recited means each comprise at least one cylinder and wherein said last recited means comprises a first winch mounted on a front portion of said main body frame, a second winch mounted on a rear portion of said main body frame, means for rotating said first and second winches, and means for operatively connecting said first and second winches to said carrier.

6. A water-bottom rubbles leveling apparatus according to claim 1 further comprising means mounted on said main body frame for selectively floating and sinking said apparatus on or into the water.

7. A method of leveling water-bottom rubbles by using a remote-controlled apparatus which is capable of self-propelling in longitudinal and lateral directions and has a rake and a leveling roller mounted thereto, said method comprising the steps of:

(a) sinking said apparatus on a water-bottom rubble-mound to be leveled;

(b) adjusting said apparatus horizontally at a datum level;

(c) leveling said rubble-mound by moving said rake horizontally in the longitudinal direction of said apparatus;

(d) moving said leveling roller on the rake-leveled rubble-mound horizontally in the longitudinal direction of said apparatus;

(e) moving said apparatus back and forth or sideways after completion of the leveling work of the assigned area;

(f) repeating the above recited steps (c) and (d) for a newly assigned area; and (g) floating said apparatus above the water after completion of entire leveling of the rubble-mound.

* * * * *